United States Patent [19]

Wong

[11] Patent Number: 4,576,500

[45] Date of Patent: Mar. 18, 1986

[54] SCAFFOLDING SYSTEM

[76] Inventor: Wah Wong, 6 Sing Woo Road, 5/F, Happy Valley, Hong Kong

[21] Appl. No.: 564,433

[22] Filed: Dec. 21, 1983

[30] Foreign Application Priority Data

Dec. 24, 1982 [GB] United Kingdom ..... 8236848

[51] Int. Cl.[4] ..... E04G 7/00; F16B 7/00

[52] U.S. Cl. ..... 403/49; 403/190; 403/246; 182/178; 211/191

[58] Field of Search ..... 403/49, 245, 246, 189, 403/190, 230; 182/178, 179; 211/191, 192, 208

[56] References Cited

U.S. PATENT DOCUMENTS

| | | | |
|---|---|---|---|
| 3,420,557 | 1/1969 | Francis et al. | 182/179 |
| 3,817,641 | 6/1974 | Steele et al. | 182/179 X |
| 3,879,143 | 4/1975 | Gostling | 403/49 |
| 3,880,533 | 4/1975 | Gostling | 403/189 |
| 3,901,609 | 8/1975 | Gostling | 403/49 |
| 4,044,523 | 8/1977 | Layher | 182/179 |
| 4,083,640 | 4/1978 | Lovering | 403/49 |
| 4,095,910 | 6/1978 | Steele et al. | 403/49 |
| 4,369,859 | 1/1983 | Smits | 403/49 X |
| 4,405,254 | 9/1983 | Tooley | 403/49 X |
| 4,493,578 | 1/1985 | D'Alessio | 403/49 |

FOREIGN PATENT DOCUMENTS

| | | | |
|---|---|---|---|
| 1310529 | 3/1973 | United Kingdom | 403/230 |
| 2061445 | 5/1981 | United Kingdom | 403/49 |

*Primary Examiner*—Cornelius J. Husar

*Assistant Examiner*—Todd G. Williams

*Attorney, Agent, or Firm*—Townsend and Townsend

[57] ABSTRACT

A ledger system for scaffolding which comprises a tubular ledger member having an end plate at one or both ends and being provided at one or both ends with a first slot extending from the end plate parallel with the axis of the tubular ledger member and a second slot also extending from the end plate parallel with the axis of the tubular ledger member and located 180° round the circumference of the tubular ledger member from the first slot, the second slot having an enlarged inner end; and a wedge member for each pair of slots being arranged to pass through the first and second slots but being prevented from being removed from the first slot by first and second retaining means located adjacent the broader and narrower ends respectively of the wedge, the width of the enlarged inner end of the second slot being such as to permit the narrower end of the wedge with the second retaining means to pass freely therethrough. Such a ledger system can be used with a standard which has one or more hook members located around its circumference, the tubular ledger member being hooked onto a hook member by means of the first and second slots through which the member passes and the wedge member being tapped into place between the hook member and the inner ends of the first and second slots. Such a system affords quick and safe single-handed erection and prevents the ledger falling off the hook even if the wedge member is not engaged.

22 Claims, 10 Drawing Figures

SCAFFOLDING SYSTEM

The present invention relates to a scaffolding system and in particular to an improved ledger system for scaffolding.

BACKGROUND TO THE INVENTION

It is known to provide a scaffolding system in which a ledger or horizontal member is releasably attached to a lug or hook provided on a standard or upright member by means of a slot member attached to the end of the ledger which receives a wedging element. However, such presently used systems are complicated to construct and awkward to use.

I have sought to provide an improved system for releasably attaching a ledger to a lug or hook of a standard which allows for quick and safe erection by single-handed operation in which the ledger will not fall off the hook even if the wedge member is not engaged.

BRIEF SUMMARY OF THE INVENTION

Accordingly the present invention provides a ledger system for scaffolding which comprises a tubular ledger member having an end plate at one or both ends and being provided at one or both ends with a first slot extending from the end plate parallel with the axis of the tubular ledger member and a second slot also extending from the end plate parallel with the axis of the tubular ledger member and located 180° round the circumference of the tubular ledger member from the first slot, the second slot having an enlarged inner end; and a wedge member for each pair of slots being arranged to pass through the first and second slots but being prevented from being removed from the first slot by first and second retaining means located adjacent the broader and narrower ends respectively of the wedge, the width of the enlarged inner end of the second slot being such as to permit the narrower end of the wedge with the second retaining means to pass freely therethrough.

In a preferred embodiment the tubular ledger member is provided at one or both ends with a guide plate located in the first and second slots and attached to the tubular ledger member at the inner ends of the first and second slots.

Preferably, the or each wedge member has a cutaway portion at its narrow end by means of which the wedge member can be seated on the tubular ledger member or the guide plate when the first and second slot of the tubular ledger member are vertically aligned.

The tubular ledger member may be provided at one or both ends with first and second holes located opposite one another and approximately 90° around the circumference of the tubular ledger member from the first and second slots, the holes being arranged to receive a pin of a diagonal brace member to hold the diagonal brace in position against the tubular ledger member.

In a particularly preferred embodiment, the end of the tubular ledger member is at an angle of inclination $\beta$ with respect to the diameter of the tubular ledger member taken on the central plane of the first and second slots. Preferably, the angle $\beta$ is from 1° to 6°, more preferably 3°.

The present invention also provides a scaffolding system which comprises a tubular ledger system having an end plate at one or both ends and being provided at one or both ends with a first slot extending from the end plate parallel with the axis of the tubular ledger member and a second slot also extending from the end plate parallel with the axis of the tubular ledger member and located 180° around the circumference of the tubular ledger member from the first slot, the second slot having an enlarged inner end; and a wedge member for each pair of slots being arranged to pass through the first and second slots but being prevented from being removed from the first slot by first and second retaining means located adjacent the broader and narrower ends respectively of the wedge, the width of the enlarged inner end of the second slot being such as to permit the narrower end of the wedge with the second retaining means to pass freely therethrough and a standard having one or more hook members located around its circumference, in use the tubular ledger member is hooked into the hook member by means of the first and second slots through which the hook member passes and the tubular ledger member is held in place on the hook member by means of the wedge member which is tapped into place between the hook member and the inner ends of the first and second slots.

In a preferred embodiment, the tubular ledger member is provided at one or both ends with a guide plate located in the first and second slots and attached to the tubular ledger member at the inner ends of the first and second slots. In this embodiment, the tubular ledger member is held in place on the hook member by means of the wedge member which is tapped into place between the hook member and the guide plate.

For preference, each hook on the standard is substantially L-shaped with the shorter arm attached to the standard and the longer arm arranged to receive the tubular ledger member.

In one embodiment, the inner edge of the longer arm of the L-shaped hook is parallel with the vertical axis of the standard and the outer edge of the longer arm of the L-shaped hook is at an angle of inclination with respect to the vertical axis of the standard so that the longer arm tapers from its free end to the end attached to the shorter arm.

In another embodiment both the inner and outer edges of the longer arm on the L-shaped hook are each at an angle of inclination with respect to the vertical axis of the standard, the angle of inclination $\alpha$ of the outer edge being greater than the angle of inclination $\beta$ of the inner edge. Preferably, the angle of inclination $\beta$ is from 1° to 6°, more preferably 3°.

In a further aspect of the invention the scaffolding system also includes a diagonal brace which in use is attached at either end to a different tubular ledger member by means of a pin which passes through the first and second holes of the tubular ledger member.

In one embodiment the pin passes through first and second holes in the diagonal brace member and is preferably held in place in the brace member by means of welding. In another embodiment, each end of the diagonal brace member is pressed together and a pin is attached, e.g., by welds, to each flattened end of the diagonal brace member.

As stated above, the ledger has, for preference, means to accept a diagonal brace which is counteracts lateral forces and keeps the whole scaffolding structure rigid. By providing means for attaching the brace to the ledger rather than the standard, the following advantages are obtained. No hooks on the standard are needed for the connection of the diagonal brace, this is quite important when all the hooks on the standard are needed to link ledgers to other standards. Furthermore, a scaffold system with diagonal braces connected to hooks on a standard will create a rotational moment about the axis of the standard thus generating bending stresses on both the ledger and standard when they are subjected to lateral forces. It also creates excessive play and is less rigid. A diagonal brace connected to a ledger will eliminate these problems. Furthermore, only a single pin is needed at each end of the brace to secure it in place onto two ledgers.

Standards come in various lengths and one standard can be connected to another standard by means of connectors so that the desired height can be achieved. Each standard carries clusters of hooks at intervals as required. Each cluster has at least one hook but normally four are preferred. The normal interval between the clusters is 500 mm. The desired number of hooks are welded to the standard symmetrically with their central planes perpendicular and parallel to the circumference and vertical axis of the standard and each hook is in alignment with the one above and the one below.

Both the inner and outer edges of the hook are for preference at an angle of inclination with respect to the vertical axis of the standard with the angle of inclination of the outer edge slightly larger than the angle of inclination of the inner edge so that the hook tapers downwardly. Because of the angle of inclination with the vertical axis of the standard, the distance between the top part of the inner edge and the circumference of the standard is larger than the distance between the bottom part of the inner edge and the circumference of the standard. This difference provides a clearance between the top part of the hook and the bottom part of the end plate of the ledger permitting easy engagement of the ledger on the hook.

Although it is generally desirable to have an angle of inclination for the inner edge of the hook, the inner edge may be made parallel to the vertical axis of the standard for easier manufacturing of the ledger because the tube forming the ledger can then be cut at right angles to its length instead of being cut at precise angles at either or both ends.

BRIEF DESCRIPTION OF THE DRAWINGS

The invention will now be described by way of example, with reference to the accompanying drawings, in which.

DESCRIPTION OF THE PREFERRED EMBODIMENTS

Figure 1:
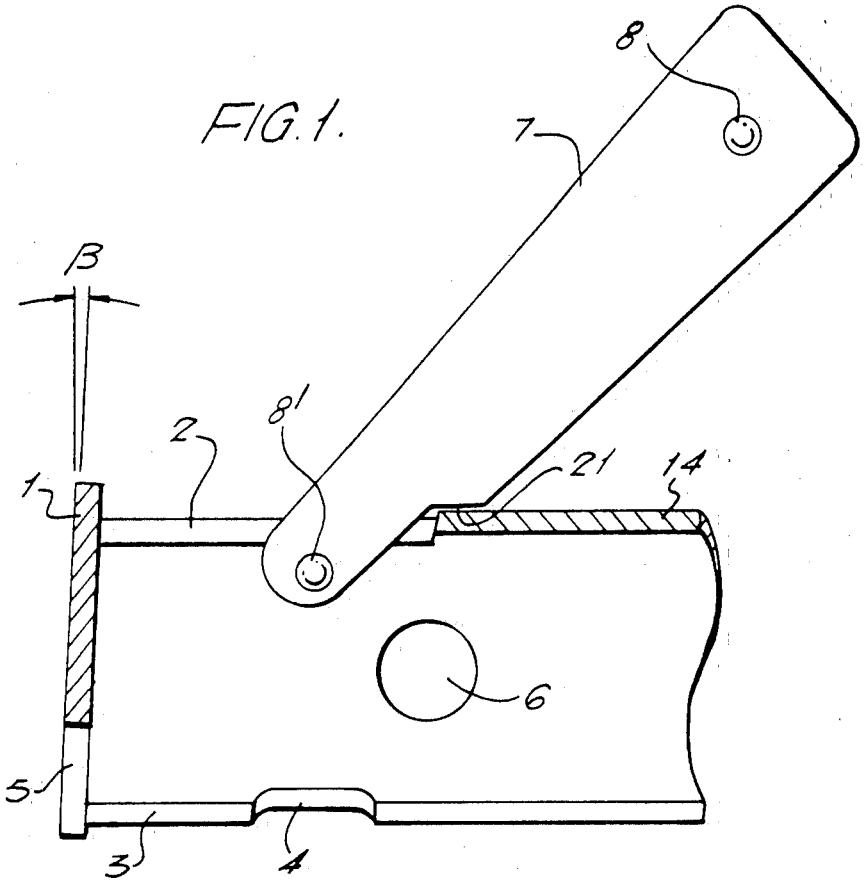
FIG. 1 is a verticl cross-section through part of a tubular ledger system in accordance with one embodiment of the present invention.
Figure 2:
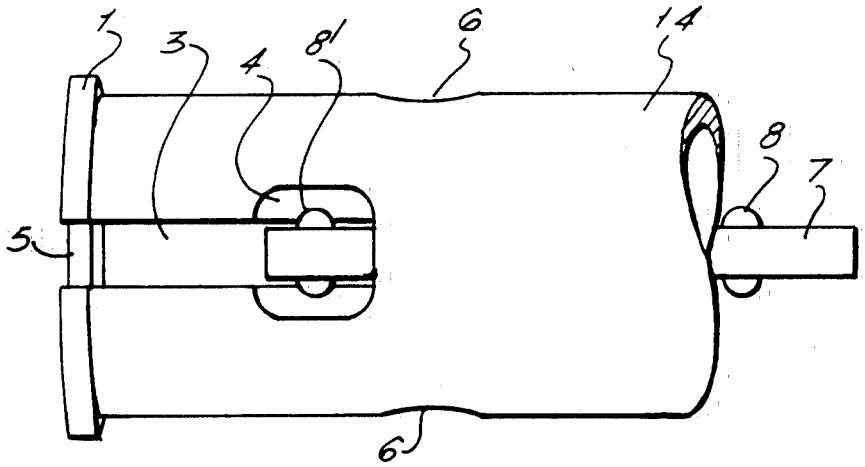
FIG. 2 shows the underside of the tubular ledger system of FIG. 1.

As shown in FIGS. 1 and 2, one embodiment of the tubular ledger system of the present invention comprises a horizontal member or ledger 14 provided with an end plate 1 having a cut-away portion 5. The ledger 14 is provided with an upper slot 2 and a lower slot 3 having an enlarged inner end 4 and holes 6 (only one visible). The central line of holes 6 is on a diameter of the ledger 14 perpendicular to the plane on which the centre lines of the top and bottom slots 2 and 3 lie. The end of the ledger 14 is cut at an angle $\beta$ with respect to the diameter of the ledger 14 taken on the central plane of slots 2 and 3. The cut-away portion 5 of the end plate 1 is coincident with the bottom slot 3 and the purpose thereof will be discussed later. A wedge 7 which has a thickness slightly less than the width of slot 2 passes freely through the slots 2 and 3 but is prevented from being removed through slot 2 from the ledger 14 by means of upper and lower retaining means in the form of rivets 8 and 8' which extend the width of the wedge at these points so that it is wider at these points than the slot 2. Although the lower slot 3 is narrower than the thickness of wedge 7, the enlarged part 4 thereof lower slot 3 is wide enough however to permit the lower end of wedge 7 with its rivets 8' to pass freely therethrough as shown more clearly in FIG. 2. Wedge 7 has a cut-away portion 21 which is provided so that the wedge 7 can be folded back to rest on the circumference of the ledger 14 without falling down when the slots 2 and 3 are aligned vertically.

Figure 3:
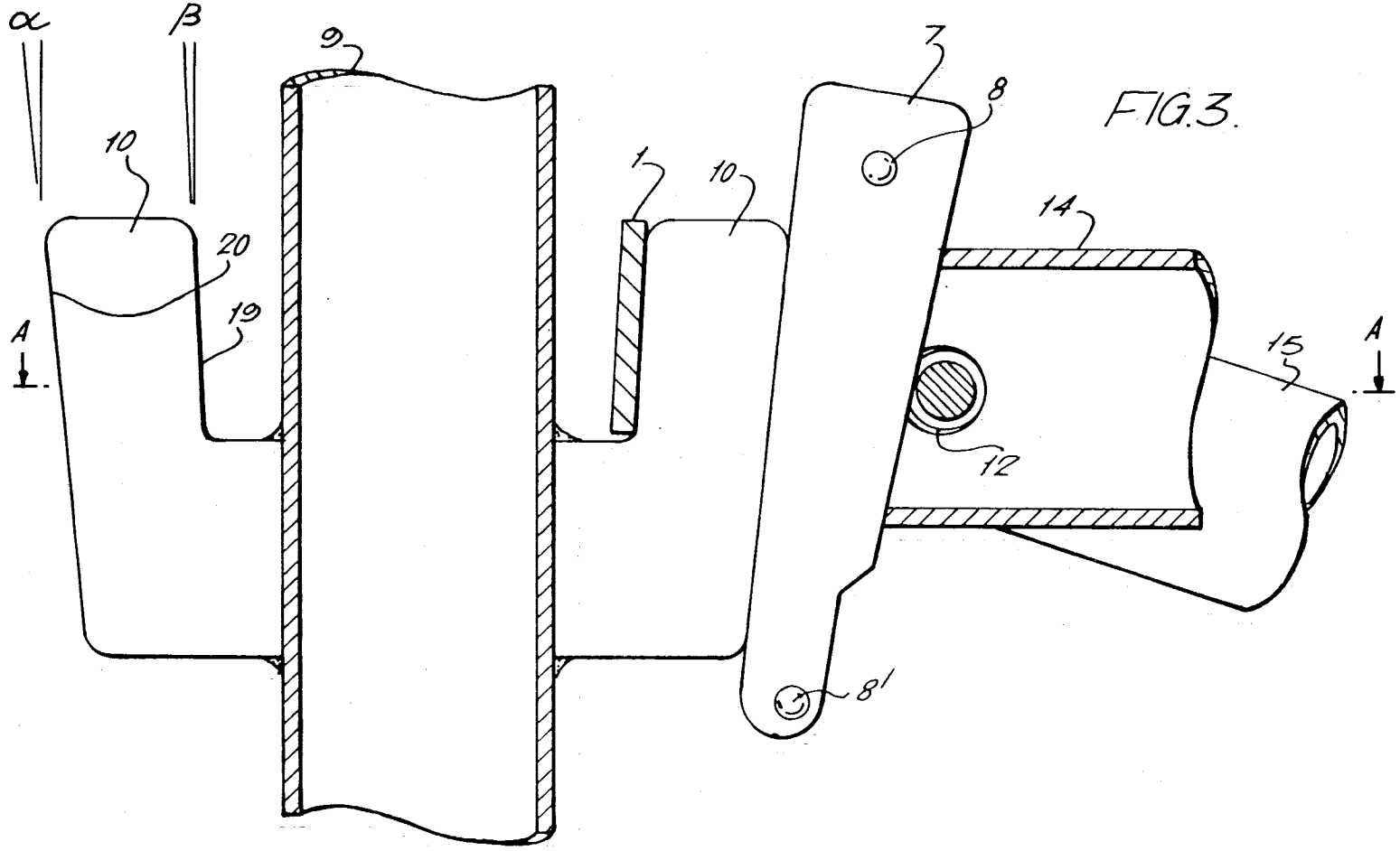
FIG. 3 is a vertical cross-section through part of a scaffolding system in accordance with one embodiment of the present invention.
Figure 4:
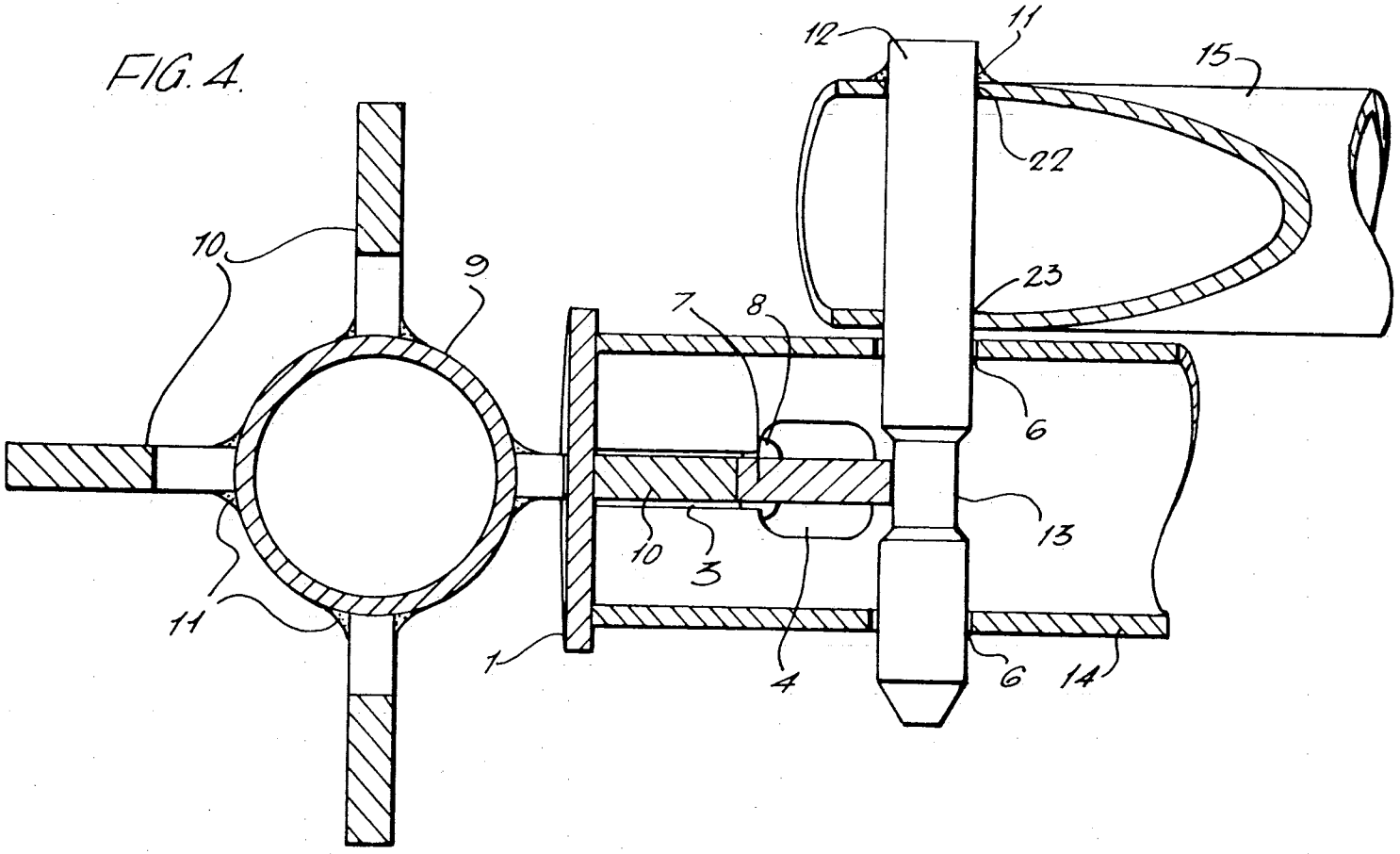
FIG. 4 is a section along line A—A of FIG. 3.

FIGS. 3 and 4 show a tubular ledger system of the type illustrated in FIGS. 1 and 2 in place on an L-shaped hook 10 of a vertical member or standard 9. As shown in FIGS. 3 and 4, the upright arm of each hook 10 has an inner edge 19 which is set at an angle $\beta$ vertical axis of standard 9 and an outer edge 20 which is set at an angle $\alpha$ to the vertical axis of standard 9. The angle $\alpha$ is greater than the angle $\beta$ so that the upright arm of hook 10 tapers downwardly.

Because of the angle of inclination $\beta$ the distance between the top part of inner edge 19 and the circumference of standard 9 is greater than the distance between the bottom part of the inner edge 19 and the circumference of standard 9 so that a clearance between the top part of hook 10 and the bottom part of the end plate 1 of ledger 14 is provided. This permits easy attachment of ledger 14 on hook 10 particularly in the situation where ledgers are already in position on the standard above and below the ledger currently being attached.

As can be seen, the lengths of the slots 2 and 3 are such that when the ledger 14 is hooked onto hook 10 of the standard 9 and the wedge 7 engaged and tapped in tightly the edge of wedge 7 will contact the inner ends of slots 2 and 3 so that the hook 10 is clamped tightly between the end plate 1 and the wedge 7.

The cut-away portion 5 of the end plate 1 is provided to accommodate a portion of the horizontal arm of the L-shaped hook 10 so that the upright arm of hook 10 does not have to be longer in order to protrude out of the top slot 2 when ledger 14 is engaged on the hook 10. Further, it transmits all the torsional forces around the axis of ledge 14 to the horizontal arm of the hook 10 which is more resistant to torsion.

A diagonal brace member 15 can be provided to resist lateral forces and to keep the whole structure rigid particularly when the scaffolding is of considerable height. It is retained in place, attached to the ledger 14 by means of a connecting pin 12 which passes through holes 22 and 23 in brace member 15 and through the holes 6 in the ledger 14. The pin 12 is prevented from passing completely through hole 22 by means of welds.

Pin 12 is tapered at its free end and is provided with a grooved or waisted portion 13 having sloping sides for easy passage through the holes 6 of ledger 14. When the ledger 14 is engaged on hook 10, the pin 12 of brace 15 is passed through the holes 6 of ledger 14 and the wedge 7 is engaged and tapped tightly in place so that the edge of the wedge 7 will seat in groove 13 of pin 12 thereby locking the diagonal brace 15 in position. Removal of brace 15 is only possible by tapping loose the wedge 7 and removing it upwards to clear the pin 12.

Figure 5:
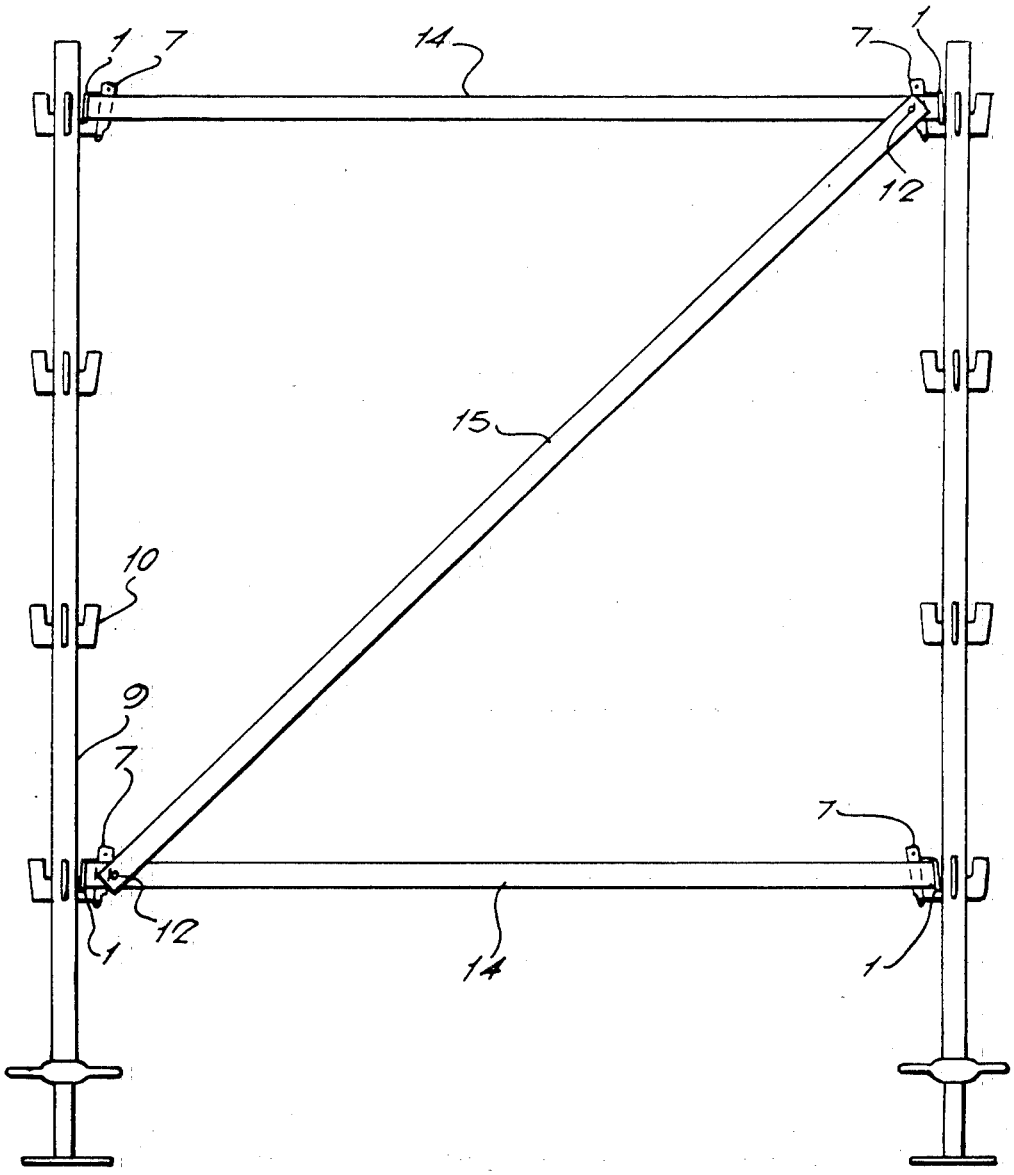
FIG. 5 is a vertical cross-section through a scaffolding construction in accordance with the present invention.

FIG. 5 shows a scaffolding construction in accordance with the present invention with two ledgers 14 engaged on hooks 10 of two standards 9. A horizontal brace 15 is shown extending between and attached to the two ledgers 14.

Figure 6:
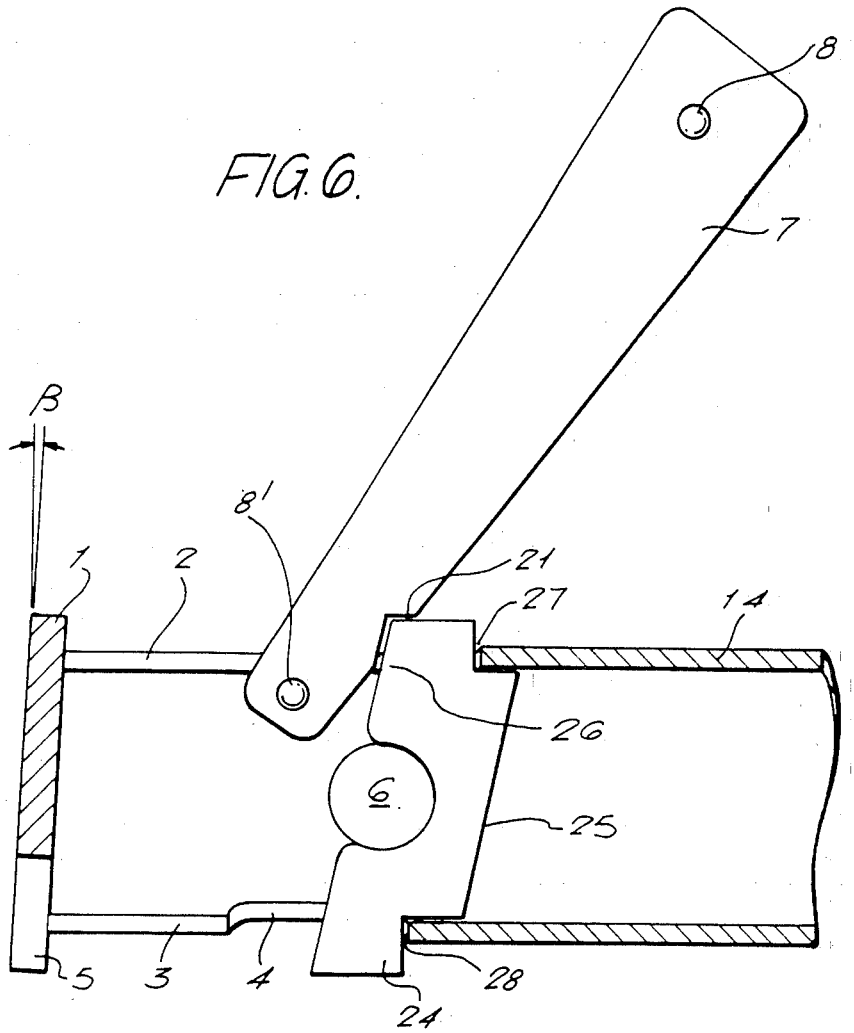
FIG. 6 is a vertical cross-section through part of a tubular ledger system in accordance with another embodiment of the present invention.
Figure 7:
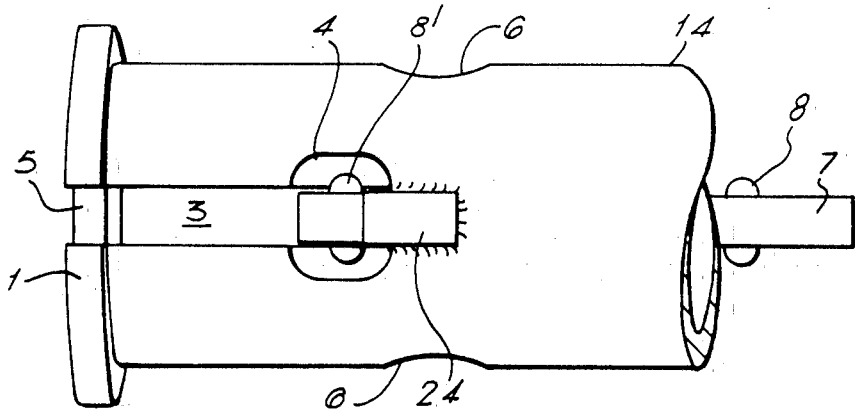
FIG. 7 shows the underside of the tubular ledger system of FIG. 6.

FIGS. 6 and 7 illustrate another embodiment of the present invention which, although similar to the embodiment illustrated in FIGS. 1 and 2, includes the additional feature of providing a guide plate 24 which is inserted through slots 2 and 3 and retained in place by being welded to the ledger 14. In this embodiment the lengths of slots 2 and 3 between the guide plate 24 and the end plate 1 are such that when the ledger 14 is hooked onto the hook 10 of the standard 9 and the wedge 7 engaged and tapped in tightly, one end of the wedge 7 will contact edge 26 of the guide plate 24 so that the hook 10 is clamped tightly between the end plate 1 and the wedge 7.

In the embodiment illustrated, the height of the guide plate 24 is slightly larger than the outside diameter of the ledger 14 to permit easy welding of the guide plate 24 to the ledger 14. Edge 25 of the guide plate 24 is so shaped to be inserted into the inner bore of the ledger 14 up to the extent of recesses 27 and 28; this, as well as ensuring easy and accurate positioning of the guide plate 24 into the slots 2 and 3 during manufacture, also provides added resistance to downward forces due to friction when the wedge 7 is driven down because part of the bottom edge of the guide plate 24 rests on the inner circumference of the ledger 14.

To take account of the holes 6 and 6' of ledger 14 for the engagement of the diagonal brace 15, a partial circular cut-out of radius equal to or slightly larger than the radius of hole 6 is provided in the guide plate 24 which the centre of this cut-out being located on the horizontal central line of the guide plate 24. The size of the cut-out is such as to permit the pin 12 of the diagonal brace 15 to pass therethrough.

The guide plate 24 provides a line contact between itself and the wedge 7 instead of the point contact between the wedge 7 and the ledger member at the inner ends of slots 2 and 3 as in the embodiment illustrated in FIGS. 1 to 3. This line contact provides better wear and tear properties between the wedge 7 and the guide plate 24 so that a longer life of the ledger system can be expected.

Figure 8:
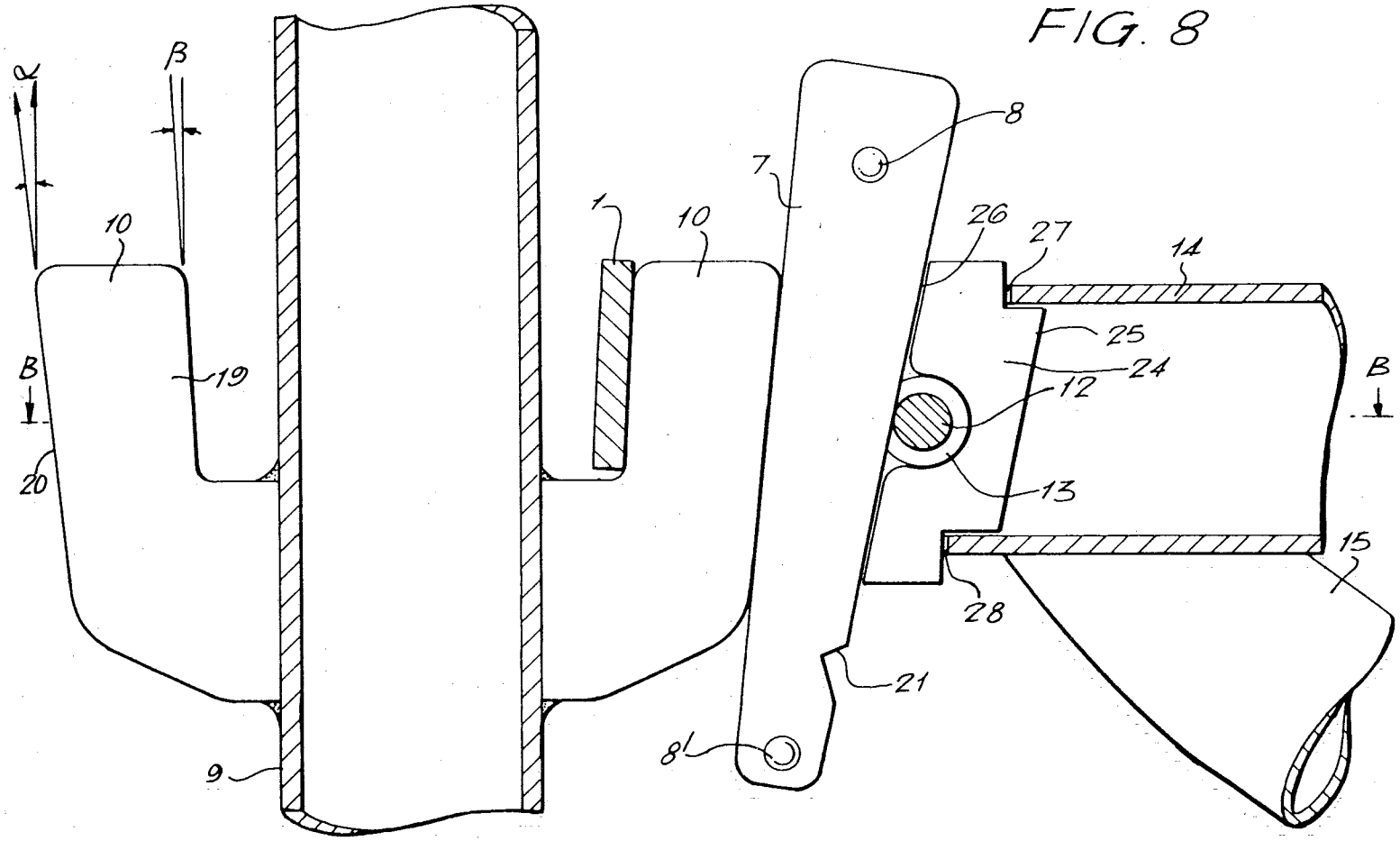
FIG. 8 is a vertical cross-section through part of a scaffolding system in accordance with another embodiment of the present invention.
Figure 9:
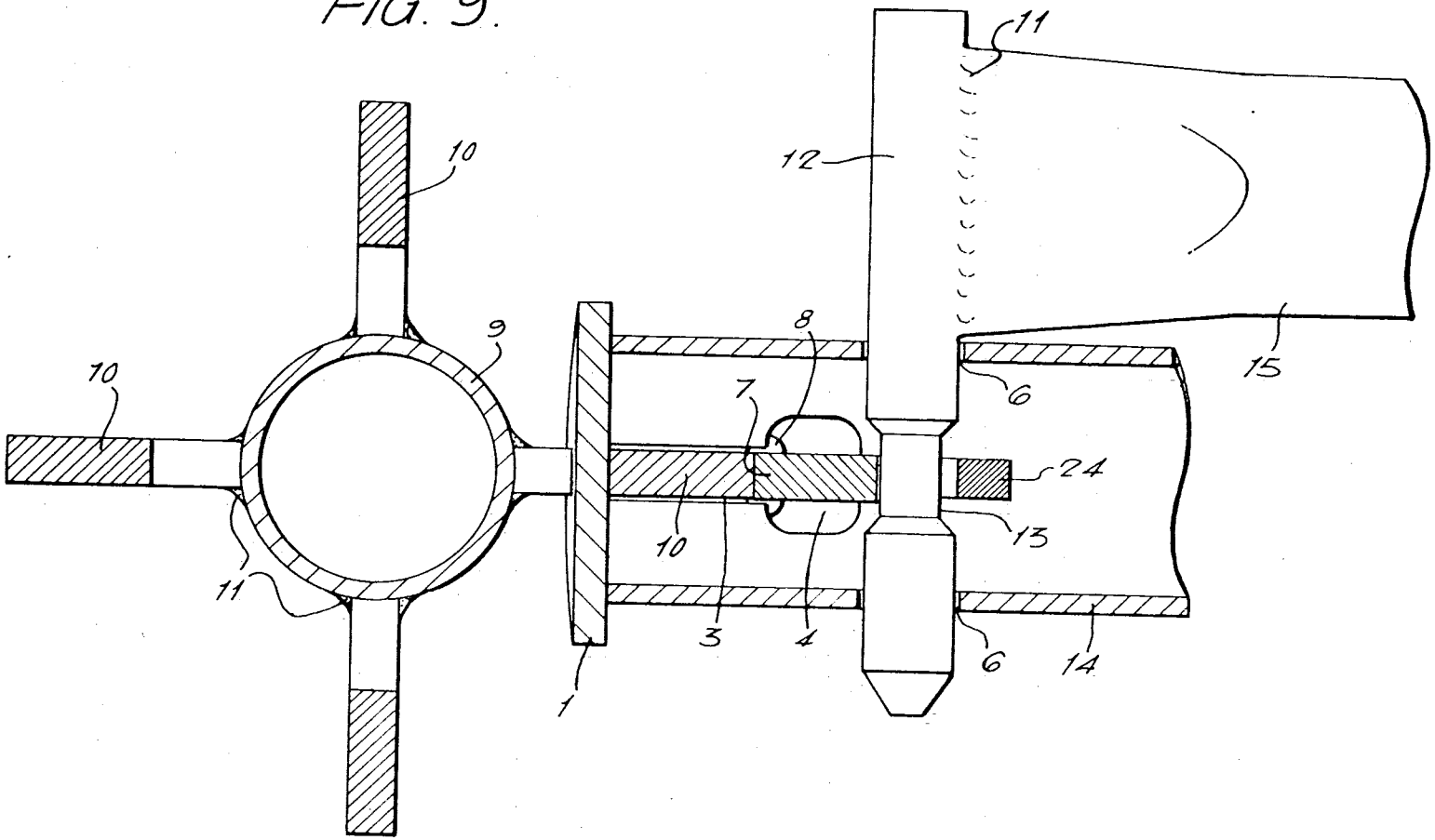
FIG. 9 is a section along line B—B of FIG. 8.
Figure 10:
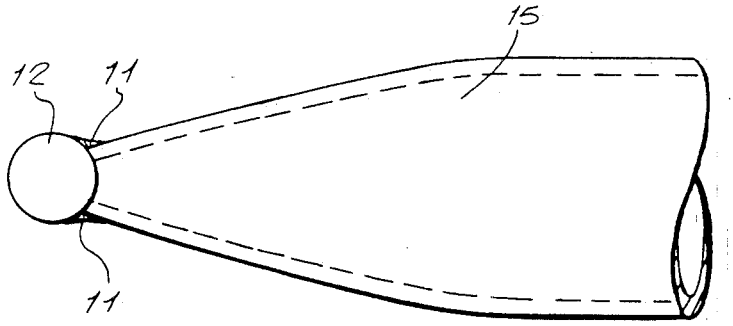
FIG. 10 is a plan view of the diagonal brace member of the scaffolding system of FIGS. 8 and 9.

In the scaffolding system illustrated in FIGS. 8 to 10, the ends of the diagonal brace 15 are pressed flat on the same horizontal plane and the pin 12 is welded at 11 symetrically to either end of the diagonal brace 15 along the line of the flattened end which is perpendicular to the central axis of the diagonal brace 15. This embodiment of the diagonal brace 15 facilitates manufacturing.

I claim:

1. A scaffolding system comprising:

a tubular ledger member having an end plate at at least one end and being provided with a pair of aligned slots, a first slot of said pair extending from said end plate parallel with an axis of said tubular ledge member and a second slot of said pair also extending from said end plate parallel with the axis of said tubular ledger member and located opposite said first slot, said second slot having an enlarged inner end;

a wedge for each pair of slots, said wedge being arranged to pass through said first and second slots and having a relatively wider end and a relatively narrower end and first and second retaining means located adjacent the ends of said wedge, said first and second retaining means being adapted to prevent said wedge from being removed from said first slot, said enlarged inner end of said second slot having a sufficient width to permit said narrower end of said wedge with said second retaining means to pass freely therethrough;

and a standard having at least one L-shaped hook attached to and protruding generally radially from said standard, the hook having a shorter arm attached to said standard and a longer arm arranged to receive said tubular ledger member and extend through the pair of slots thereof, said longer arm having an inner edge and an outer edge, the inner and outer edges being angularly inclined with respect to each other so that said longer arm is relatively wider at its free end than at the end attached to the shorter arm;

the wedge being tapered so that its edges simultaneously engage the inner ends of the slots and at least a substantial portion of the entire length of the outer edge of the long arm when the wedge and the long arm are disposed in the pair of slots and their relatively wider ends are proximate each other;

whereby said tubular ledger member can be secured to said hook member by extending the longer arm through said first and second slots and tapping the wedge into place between said longer arm and the inner ends of said first and second slots.

2. A scaffolding system as recited in claim 1 wherein the end plate of said tubular ledger member has an angle of inclination $\beta$ with respect to the diameter of said tubular member taken on the central plane of said pair of slots.

3. A scaffolding system according to claim 2 wherein said angle $\beta$ is from 1° to 6°.

4. A scaffolding system as recited in claim 2 wherein said angle $\beta$ is 3°.

5. A scaffolding system as recited in claim 1 wherein both the inner and outer edges of said longer arm of said L-shaped hook are each at an angle of inclination with respect to the vertical axis of said standard, the angle of inclination $\alpha$ of the outer edge being greater than the angle of inclination $\beta$ of the inner edge.

6. A scaffolding system as recited in claim 5 wherein said angle $\beta$ is from 1° to 6°.

7. A scaffolding system as recited in claim 5 wherein said angle $\beta$ is 3°.

8. A scafffolding system as recited in claim 1 wherein each of said wedge members has a cutaway portion at its narrower end by means of which said wedge can be seated on said tubular ledger member when said first and second slots of said tubular ledger member are vertically aligned.

9. A scaffolding system as recited in claim 1 including a pin and a diagonal frace for attachment to the ledger member, wherein said tubular ledger member is provided at at least said one end with first and second holes located opposite one another and at approximately 90° from the first and second slots, said holes being arranged to receive the pin for holding said diagonal brace in position against said tubular ledger member, add means for engaging the pin with said wedge member.

10. A scaffolding system as recited in claim 9 including first and second apertures in said diagonal brace member, and wherein said pin passes through the first and second apertures.

11. A scaffolding system as recited in claim 9 wherein each end of said diagonal brace member is flattened and a pin is attached to each flattened end of said diagonal brace member.

12. A scaffolding system comprising:

a tubular ledger member having an end plate at at least one end and a pair of aligned, opposed first and second slots extending from said end plate substantially parallel with an axis of said tubular ledger member, one of said slots having an inner end of an enlarged width;

said tubular ledger member being provided with a guide plate located in said first and second slots and being attached to said tubular ledger member at ends of said slots spaced from the end plate;

a wedge for each pair of slots being arranged to pass through said slots, said wedge having a relatively wider end and a relatively narrower end and first and second retaining means located adjacent the ends of said wedge, said first and second retaining means being adapted to prevent said wedge from being removed from the other one of the slots, said enlarged inner end of said one slot having a width such as to permit the narrower end of said wedge member with said second retaining means to pass freely therethrough;

and a standard having at least one substantially L-shaped hook attached to and protruding generally radially from said standard, the hook having a shorter arm attached to said standard and a longer arm arranged to receive said tubular ledge member and extend through the pair of slots thereof; said longer arm having an inner edge and an outer edge, the inner and outer edges being angularly inclined with respect to each other so that said longer arm is relatively wider at its free end than at the end attached to said shorter arm;

the wedge being tapered so that its edges simultaneously engage the guide plate and at least a substantial portion of the entire length of the outer edge of the long arm when the wedge and the long arm are disposed in the pair of slots and their relatively wider ends are proximate to each other;

whereby said tubular ledger member can be secured to said hook member by extending the longer arm through the pair of slots and tapping the wedge into place between said longer arm and said guide plate.

13. A scaffolding system as recited in claim 12 wherein the end plate of said tubular ledger member has an angle of inclination $\beta$ with respect to the diameter of said tubular member taken on the central plane of said first and second slots.

14. A scaffolding system according to claim 13 wherein said angle $\beta$ is from 1° to 6°.

15. A scaffolding system as recited in claim 13 wherein said angle $\beta$ is 3°.

16. A scaffolding system as recited in claim 12 wherein both the inner and outer edges of said longer arm of said L-shaped hook are each at an angle of inclination with respect to the vertical axis of said standard, the angle of inclination $\alpha$ of the outer being greater than the angle of inclination $\beta$ of the inner edge.

17. A scaffolding system as recitedin claim 16 wherein said angle $\beta$ is from 1° to 6°.

18. A scaffolding system as recited in claim 16 wherein said angle $\beta$ is 3°.

19. A scaffolding system as recited in claim 12 wherein said wedge has a cutaway portion at its narrower end by means of which said wedge can be seated on said tubular ledger member when said first and second slots of said tubular ledger member are vertically aligned.

20. A scaffolding system according to claim 12 wherein the relatively wider ends of the long arm and the wedge are the respective upper ends thereof.

21. A scaffolding system comprising:

a tubular ledger member having an end plate at at least one end and being provided with a pair of aligned first and second slots extending from said end plate parallel with the axis of said tubular ledger member;

said second slot having an enlarged inner end;

a wedge for each pair of slots being arranged to pass through said first and second slots and having first and second retaining means located adjacent the wider and narrower ends, respectively, of said wedge for preventing the removal of the wedge from the first slot;

the width of said enlarged inner end of said second slot being such as to permit said narrower end of said wedge with said second retaining means to pass freely therethrough;

a standard having at least one substantially L-shaped hook attached to and substantially radially protruding from said standard, a shorter arm of each hook member being attached to said standard and a longer arm being arranged to receive said tubular ledger member; and inner edge of said longer arm of each hook being substantially parallel with the vertical axis of said standard and an outer edge of said longer arm of each hook being at an angle of inclination with respect to the vertical axis of the standard so that said longer arm tapers from its free end to the end attached to said shorter arm;

whereby in use said tubular ledger member is hooked onto said hook by means of said first and second slots through which said hook passes, and said tubular ledger member is held in place on said hook member by means of said wedge which is tapped into place between said hook and the inner ends of said first and second slots.

22. A scaffolding system comprising:

a tubular ledger member having an end plate at at least one end and being provided with a pair of first and second slots extending from said end plate parallel with the axis of said tubular ledger member;

said second slot having an enlarged inner end;

said tubular ledger member being provided with a guide plate located in said first and second slots and attached to said tubular ledger member at the inner ends of said first and second slots;

a wedge for each pair of slots being arranged to pass through said first and second slots and having first and second retaining means located adjacent the wider and narrower ends, respectively, of said wedge for preventing the removal of the wedge the first slot;

the width of said enlarged inner end of said second slot being such as to permit the narrower end of said wedge with said second retaining means to pass freely therethrough; and a standard having at least one substantially L-shaped hook attached to and substantially radially protruding from said standard, a shorter arm of each hook being attached to said standard and a longer arm being arranged to receive said tubular ledger member; an inner edge of said longer arm of each hook being substantially parallel with the vertical axis of said standard and an outer edge of said longer arm of each hook being at an angle of inclination with respect to the vertical axis of the standard so that said longer arm tapers from its free end to the end attached to said shorter arm;

whereby in use said tubular ledger member is hooked onto said hook by means of said first and second slots through which said hook passes and said tubular ledger member is held in place on said hook by means of said wedge which is tapped into place between said hook and said guide plate.

* * * * *